US010286444B2

(12) United States Patent
Sugiyama et al.

(10) Patent No.: US 10,286,444 B2
(45) Date of Patent: May 14, 2019

(54) SPRUE STRUCTURE FOR LOW-PRESSURE CASTING DEVICE AND LOW-PRESSURE CASTING DEVICE HAVING SAID SPRUE

(71) Applicant: Nissan Motor Co., Ltd., Yokohama-shi, Kanagawa (JP)

(72) Inventors: Yuta Sugiyama, Kanagawa (JP); Carl Schubeler, Kanagawa (JP); Giichirou Okamura, Kanagawa (JP)

(73) Assignee: Nissan Motor Co., Ltd., Yokohama-shi, Kanagawa (JP)

( * ) Notice: Subject to any disclaimer, the term of this patent is extended or adjusted under 35 U.S.C. 154(b) by 0 days.

(21) Appl. No.: 15/549,470

(22) PCT Filed: Feb. 19, 2015

(86) PCT No.: PCT/JP2015/054595
§ 371 (c)(1),
(2) Date: Aug. 8, 2017

(87) PCT Pub. No.: WO2016/132503
PCT Pub. Date: Aug. 25, 2016

(65) Prior Publication Data

US 2018/0021847 A1 Jan. 25, 2018

(51) Int. Cl.

| | |
|---|---|
| ***B22C 9/08*** | (2006.01) |
| ***B22D 18/04*** | (2006.01) |
| ***B22D 18/08*** | (2006.01) |

(52) U.S. Cl.
CPC ..... *B22C 9/082* (2013.01); *B22C 9/08* (2013.01); *B22D 18/04* (2013.01); *B22D 18/08* (2013.01)

(58) Field of Classification Search
CPC ..... B22C 9/08; B22C 9/082; B22D 18/04; B22D 18/08
USPC ..... 164/133, 337, 254, 256, 257, 258
See application file for complete search history.

(56) References Cited

U.S. PATENT DOCUMENTS

| | | | | | |
|---|---|---|---|---|---|
| 4,976,305 | A | * | 12/1990 | Tanaka et al. ..... | B22D 17/2218 164/154.4 |
| 5,355,934 | A | * | 10/1994 | Uozumi et al. ..... | B22D 18/06 164/255 |
| 5,423,369 | A | * | 6/1995 | Ota et al. ..... | B22D 18/06 164/119 |
| 5,454,416 | A | * | 10/1995 | Ota et al. ..... | B22D 18/06 164/254 |
| 5,462,107 | A | * | 10/1995 | Hasegawa et al. .... | B22D 18/06 164/119 |

FOREIGN PATENT DOCUMENTS

| | | | | | |
|---|---|---|---|---|---|
| JP | 62-21450 | A | * | 1/1987 | ..... B22D 17/22 |
| JP | H10034311 | A | | 2/1998 | |
| JP | 2003251453 | A | | 9/2003 | |
| JP | 2014050883 | A | | 3/2014 | |

* cited by examiner

*Primary Examiner* — Kevin P Kerns
(74) *Attorney, Agent, or Firm* — Young Basile Hanlon & MacFarlane, P.C.

(57) ABSTRACT

A sprue for a low-pressure casting device includes a stalk connection part to be connected to a stalk, a molten metal reservoir and a cavity connection part to be connected to the cavity. The shape of the molten metal reservoir is such that the perimeter of the cross section perpendicular to the flow direction of molten metal gradually increases toward the cavity connection part while the area of the cross section remains constant.

9 Claims, 8 Drawing Sheets

A—A'

B–B'

SPRUE STRUCTURE FOR LOW-PRESSURE CASTING DEVICE AND LOW-PRESSURE CASTING DEVICE HAVING SAID SPRUE

TECHNICAL FIELD

The present invention relates to a sprue structure for a low-pressure casting device and a low-pressure casting device, in particular to a sprue structure that enables both reduction of the cycle time and prevention of oxidation of molten metal and a low-pressure casting device with the sprue.

BACKGROUND

A low-pressure casting device typically includes a holding furnace for storing molten metal, a mold having a cavity and a stalk that communicates the holding furnace with a cavity, which is used for molding a casting by increasing the pressure in the holding furnace to supply the molten metal to the cavity through the stalk and allowing the molten metal to solidify.

A casting device is disclosed in JP 2003-251453A, which includes a molten metal passage for supplying molten metal to a cavity, having a circular cross section perpendicular to the longitudinal direction.

In the above-described device of JP 2003-251453A, it is difficult to supply molten metal to a wide area in a cavity since the molten metal passage has a circular cross section. Due to such poor delivery (running property), it has been difficult to produce a product having a complex shape or a thin product in which molten metal is rapidly cooled.

In order to improve the delivery, a flat fan gate has been provided in a sprue to supply molten metal to a wide area.

However, when the cross-sectional shape of the molten metal passage greatly changes at the connection part between the sprue and the fan gate, the change of the flow rate of the molten metal causes ruffle in the molten metal surface, which may produce an oxide in the new surface of the molten metal and result in the degraded quality of molded products.

In particular, since increasing the supply rate of the molten metal is likely to cause large ruffle, it is difficult to achieve both reduction in supply time of the molten metal and reduction in oxide production.

In order to improve the delivery while preventing ruffle of the molten metal, one possible measure is to flatten the entire sprue while keeping the cross-sectional shape of the sprue. However, the entirely flat sprue makes it difficult to adjust the solidification time of molten metal according to the size and shape of molded products. As a result, clogging of the sprue is more likely to occur, in which a molded product cannot be released from the sprue.

The present invention has been made in view of such problems with the prior art, and an object thereof is to provide a sprue for a low-pressure casting device which enables reduction of the cycle time and also prevents oxidation of molten metal and which hereby enables efficient production of high-quality molded products, and a low-pressure casting device with the sprue.

SUMMARY

As a result of a keen study for achieving the above-described object, the present inventors have found that the above-described object can be achieved by a molten metal reservoir of a sprue communicating a stalk with a cavity that is formed into a specific shape. The present invention was thus completed.

That is, the sprue structure for a low-pressure casting device of the present invention includes a molten metal reservoir that has a cross section perpendicular to the flow direction of molten metal such that the perimeter of the cross section gradually increases toward a cavity while the area of the cross section remains constant.

The low-pressure casting device of the present invention includes the above-described sprue for a low-pressure casting device that communicates a stalk with a cavity of a mold.

In the present invention, since the molten metal reservoir of the sprue of the low-pressure casting device has a shape such that the cross-sectional perimeter of the molten metal passage gradually increases toward the cavity while the cross-sectional area thereof remains constant, the cavity connection part has a flat shape. This enables supplying the molten metal to a wide area of the cavity, and the delivery is therefore improved. Further, this also reduces the change of the flow rate of the molten metal flowing through the sprue.

Therefore, even when the supply rate of the molten metal is increased, production of further oxide is prevented since the molten metal does not ruffle, which enables production of high-quality molded products. As a result, it is possible to achieve both reduction of the cycle time and production of high-quality molded products.

Furthermore, since the cross-sectional perimeter near the cavity is long while the cross-sectional perimeter near the stalk is short, the heat dissipation is higher near the cavity. This promotes solidification of the molten metal, and the cycle time is therefore reduced. Further, the molten metal is cooled less near the stalk. This adjusts the solidification time of the molten metal, and clogging of the sprue is therefore prevented.

BRIEF DESCRIPTION OF THE DRAWINGS

FIG. 3A is a plan view, and FIG. 3B is a front view.

DETAILED DESCRIPTION OF THE EMBODIMENTS

The sprue for a low-pressure casting device of the present invention will be described.

Figure 1A:
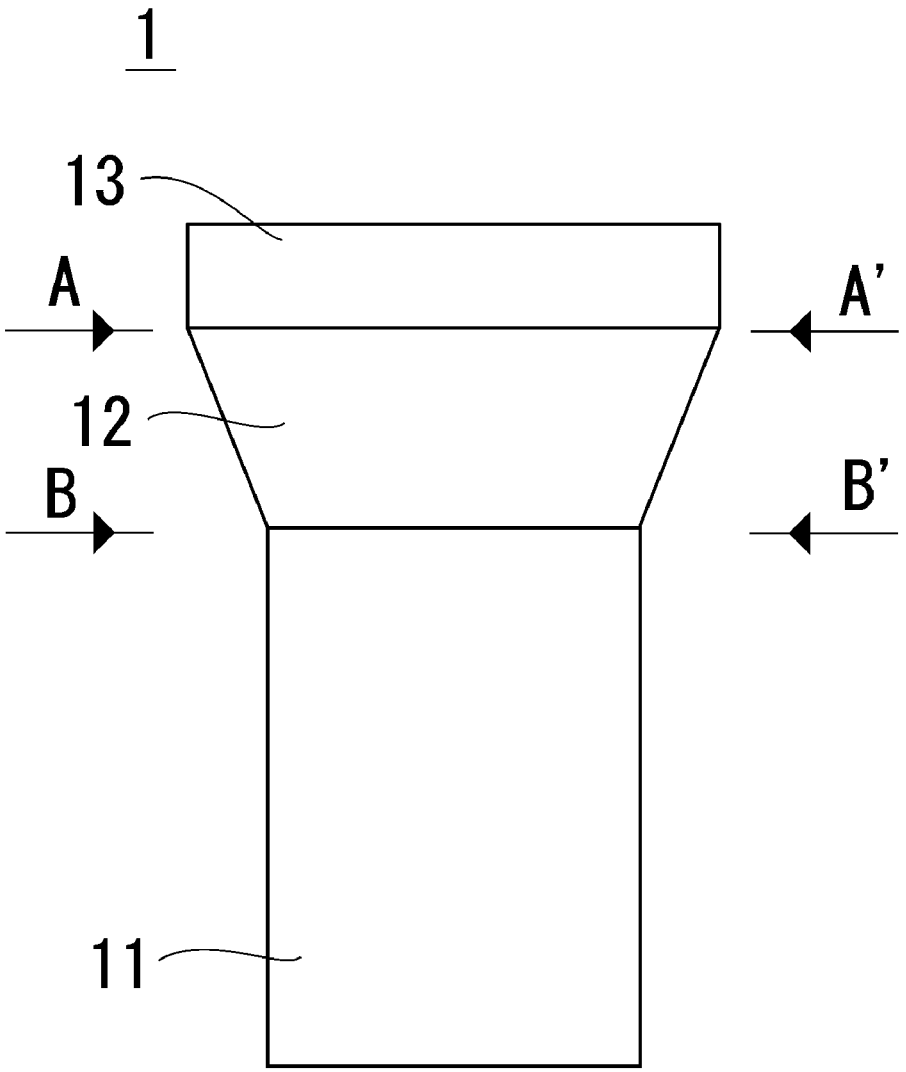
FIGS. 1A, 1B, 1C and 1D illustrate an example of the sprue for a low-pressure casting device of the present invention.
Figure 1B:
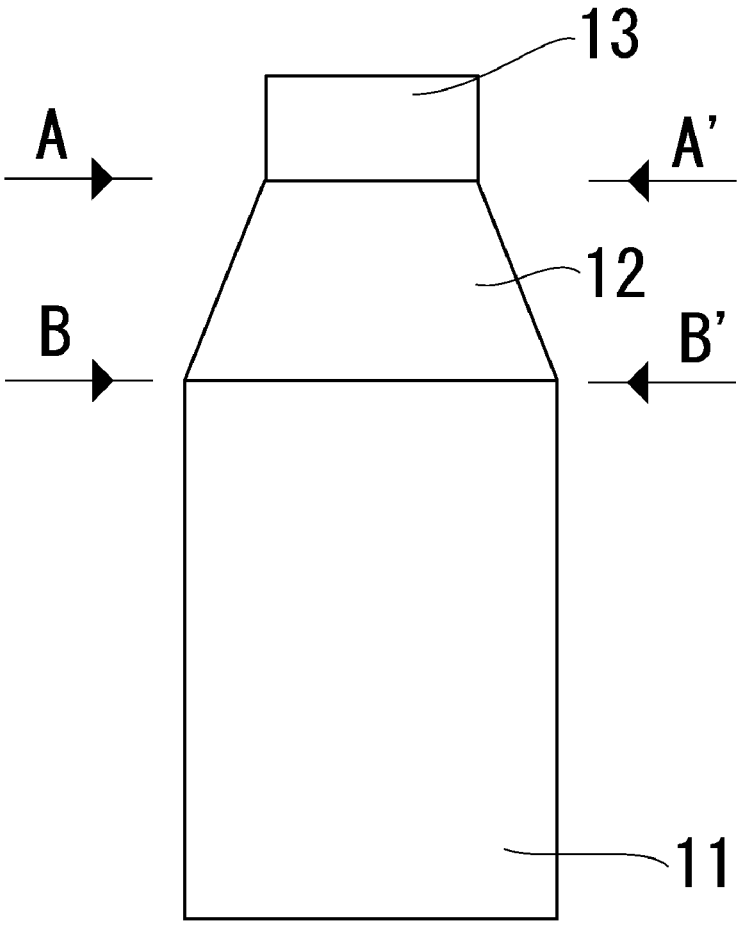
Figure 1C:
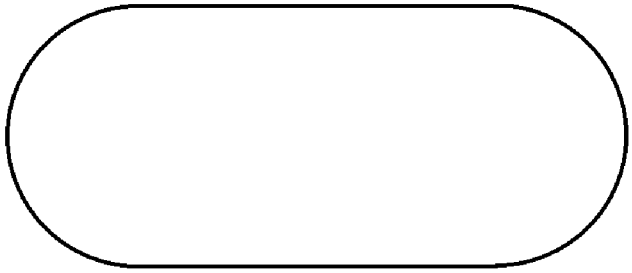
Figure 1D:
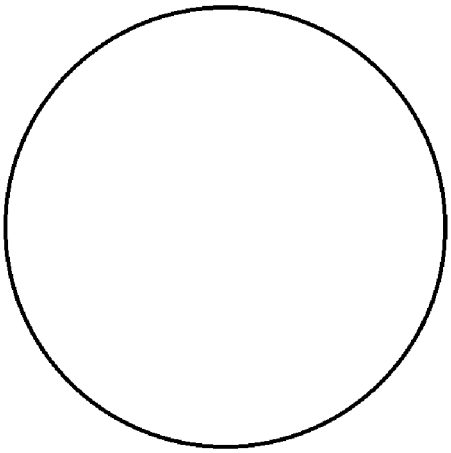

A sprue 1 for a low-pressure casting device according to the present invention is used to communicate a stalk of a low-pressure casting device with a cavity of a mold. FIGS. 1A, 1B, 1C and 1D illustrate an example of the sprue 1 for a low-pressure casting device according to the present invention. FIG. 1A is a front view of the sprue for a low-pressure casting device, and FIG. 1B is a side view of the sprue for a low-pressure casting device. FIG. 1C illustrates a cross section taken along A-A', i.e. an example of the cross-sectional shape at the upper end of a molten metal reservoir 12, and FIG. 1D illustrates a cross section taken along B-B', i.e. an example of the cross-sectional shape at the lower end of the molten metal reservoir 12.

As illustrated in FIGS. 1A, 1B, 1C and 1D, the sprue 1 for a low-pressure casting device according to the present invention includes a stalk connection part 11 that is connected to a stalk, the molten metal reservoir 12 and a cavity connection part 13 that is connected to a cavity.

The shape of the molten metal reservoir 12 is such that the perimeter of a cross section perpendicular to the flow direction of molten metal gradually increases toward the cavity connection part 13 while the area of the cross section remains constant.

Since the molten metal reservoir 12 has a shape such that the perimeter of the molten metal passage is longer at the lower end than at the upper end while the cross-sectional area of the molten metal passage remains the same, the change of the flow rate of the molten metal is reduced. Further, since the cavity connection part 13 that is disposed above the molten metal reservoir has a flat shape due to the long cross-sectional perimeter, which is described later, it is possible to supply molten metal to a wide area, and the delivery is thus improved.

Therefore, even when the supply rate of the molten metal is increased, the molten metal does not squirt into the cavity through the sprue in supplying the molten metal due to the combination of the reduction of the change of the flow rate and the improvement of the delivery. Instead, the level of the molten metal surface is equalized in the cavity, and oxidation of the molten metal is therefore reduced. Furthermore, formation of sand marks, which are caused by collision of the molten metal with a core, are prevented.

It is preferred that the molten metal reservoir 12 has a ratio of the cross-sectional perimeter at the upper end/the cross-sectional perimeter at the lower end of 1.05 or more.

Since the cross-sectional perimeter at the upper end is 1.05 times or more than the cross-sectional perimeter at the lower end, there is a large difference in heat dissipation between the upper end and the lower end of the molten metal reservoir 12. This promotes solidification of the molten metal in the cavity connection part 13 disposed above the molten metal reservoir 12, and the cycle time therefore thus reduced.

The cross section at the upper end of the molten metal reservoir 12 may be of any shape that has a perimeter longer than the cross section at the lower end. Examples of such shapes include polygonal shapes such as rectangular, trapezoidal and pentagonal shapes as well as an oval shape. When the ratio of the minor axis/the major axis of an oval is equal to or less than approximately 0.6, the ratio of the cross-sectional perimeter at the upper end/the cross-sectional perimeter at the lower end is equal to or greater than 1.05. In the case of a polygonal shape, it may be chamfered to have a curved line. As illustrated in FIG. 1C, adjacent curved lines may be continued to each other to form a single curved line.

The cross section at the lower end of the molten metal reservoir 12 is preferably of a perfect circular shape. A perfect circular shape has the shortest perimeter among any figures with the same area, and such a perfect circular shape reduces the heat dissipation. Therefore, the molten metal is less likely to solidify below the molten metal reservoir, and clogging of the sprue is thus prevented.

The cavity connection part 13, which is disposed above the molten metal reservoir, has approximately the same cross-sectional shape as the upper end of the molten metal reservoir 12.

By allowing the molten metal to solidify not only in the cavity but also in the cavity connection part 13, a molded product with a perfect shape can be obtained.

That is, with the cavity connection part 13, the molten metal is supplied from the molten metal reservoir 12 even when the molten metal in the cavity connection part 13 is solidified so that the volume is decreased. Therefore, formation of shrinkage cavities is prevented.

By changing the length of the cavity connection part 13 in the flow direction of the molten metal, i.e. the height direction, to adjust the surface area thereof, it is possible to adjust the difference in temperature between the molten metal in the cavity and the molten metal in the molten metal reservoir so as to adjust the solidification time. On the outer wall of the cavity connection part 13, a heatsink may be provided to promote solidification of the molten metal.

As described above, the cavity connection part 13 has the same cross-sectional shape as the upper end of the molten metal reservoir 12. However, as long as the flow rate of the molten metal is not greatly changed, it may have a similarity shape such that the cross section expands toward the cavity.

The expanding shape toward the cavity improves the ease of releasing a molded product and prevents clogging of the sprue that is caused by a solidified material stuck in the cavity connection part 13.

The stalk connection part 11 is disposed below the molten metal reservoir 12 and is connected to the stalk. The stalk connection part 11 has approximately the same cross-sectional shape as the lower end of the molten metal reservoir 12.

It is preferred that the cross section of the stalk connection part 11 is of a perfect circular shape. The perfect circular shape allows changing the attaching angle of the sprue to the stalk according to the shape of a product to be casted, which can improve the delivery according to the shape of a product to be casted.

Figures 2A, 2B:
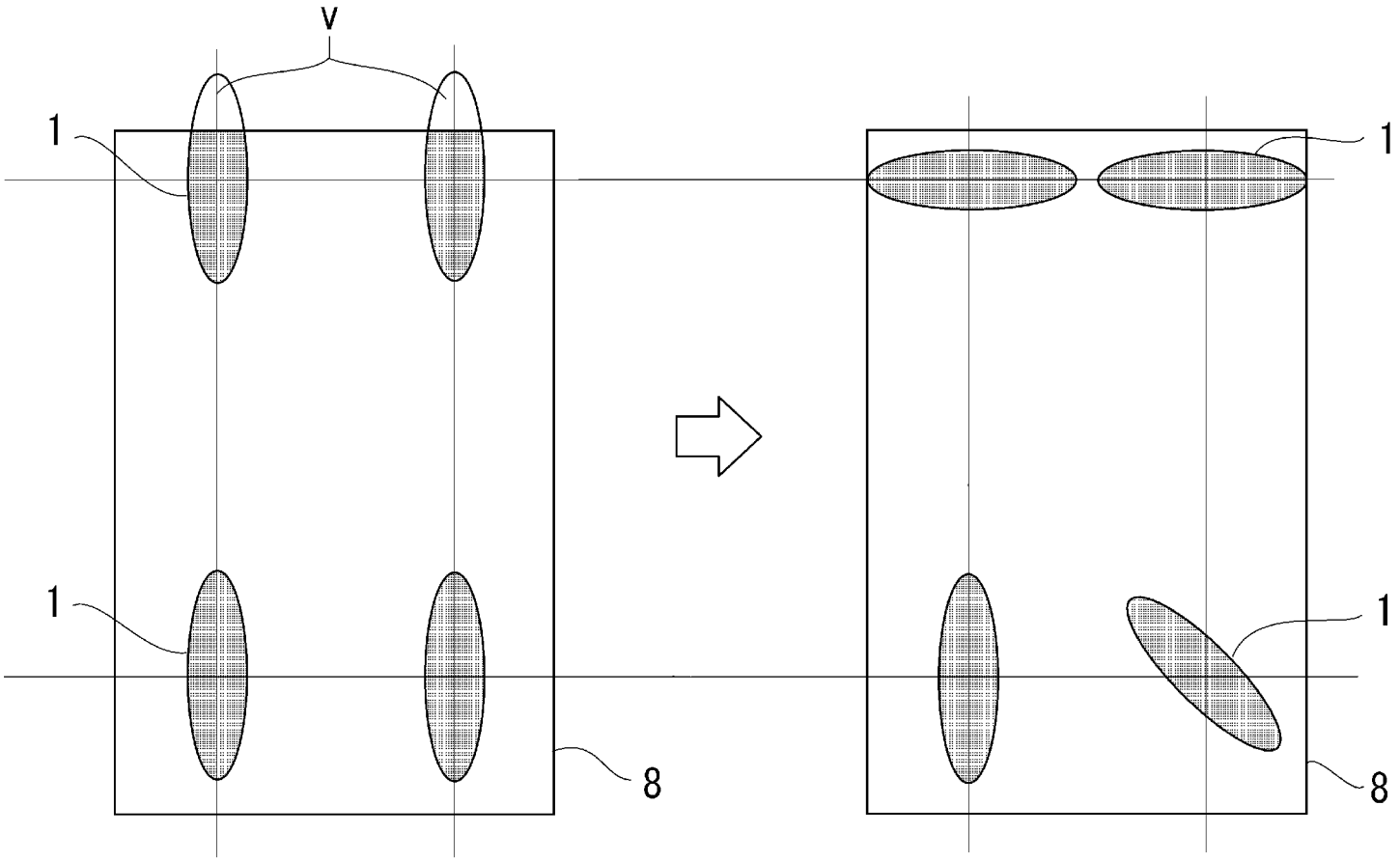
FIGS. 2A and 2B illustrate a condition in which the attaching angle of sprues to stalks are changed and an example of the positional relationship between the sprues and a molded product.

When there is a constraint in the connection between the stalk and the mold, for example, even when the cavity connection parts 13 of the sprues 1 stick out of a molded product 8 as illustrated in FIG. 2A, it is possible to change the attaching angle of the sprues 1 to the stalks as illustrated in FIG. 2B so as to arrange the cavity connection parts 13 of the sprues inside the outer shape of the molded product 8. This can prevent addition of useless shapes (v) that are added outside the outer shape of the molded product 8 according to the shape of the sprues. Therefore, an unwanted increase in weight of the molded product 8 is prevented.

It is preferred that the sprue 1 for a low-pressure casting device according to the present invention includes a heater 14 for heating the molten metal reservoir 12. With the heater 14, solidification of the molten metal in the molten metal reservoir 12 is prevented. Further, together with the cavity connection part 13 with high heat dissipation property due to the long cross-sectional perimeter, it enables adjustment of the boundary position between molten metal and solidified metal in the sprue 1.

Figure 3A:
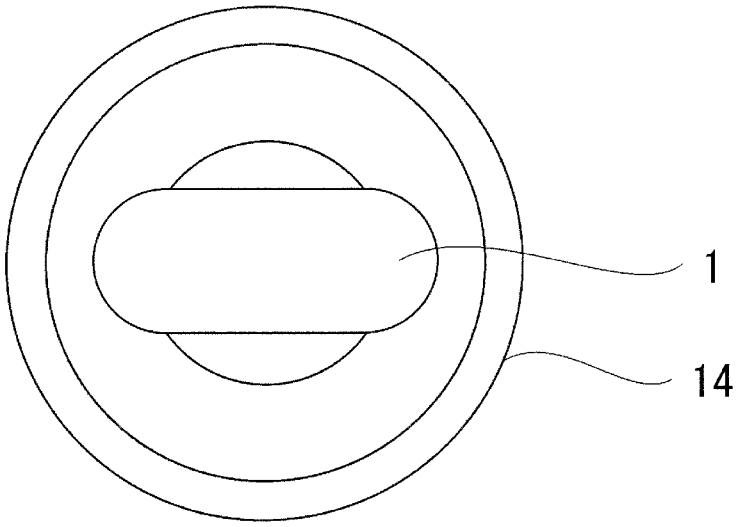
FIGS. 3A and 3B illustrate an example in which a heater is provided to the sprue for a low-pressure casting device of the present invention, where
Figure 3B:
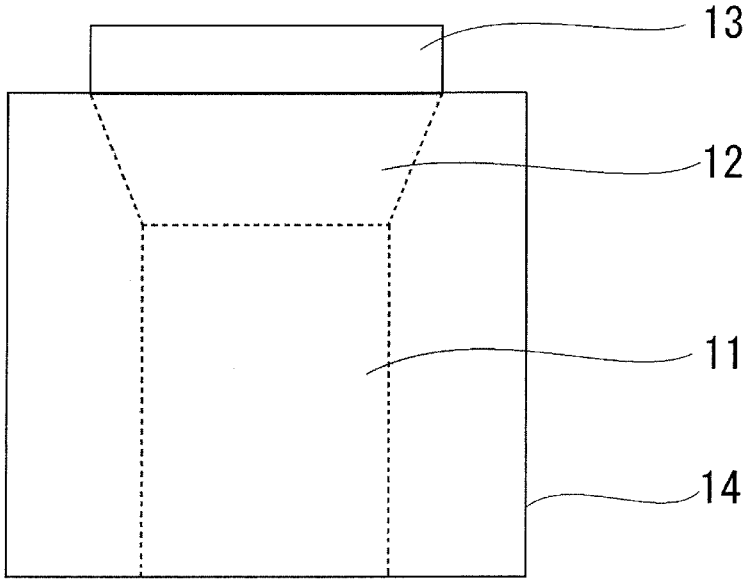

FIGS. 3A and 3B illustrate an example of a condition in which the heater 14 is provided to the sprue 1 for a low-pressure casting device. FIG. 3A is a plan view, and FIG. 3B is a front view. As illustrated in FIGS. 3A and 3B, the heater may be disposed around the molten metal reservoir 12 and the stalk connection part 11, which are illustrated by dashed lines in FIG. 3B. Alternatively, the heater may be directly disposed to the sprue.

Low-Pressure Casting Device

Next, the low-pressure casting device of the present invention will be described. A low-pressure casting device 100 according to the present invention includes a holding furnace 3 for holding molten metal 2, a stalk 4 with the lower end dipped in the molten metal 2 in the holding furnace 3, the sprue 1 for a low-pressure casting device that communicates a stalk 4 with a cavity 6 of a mold 5, and a pressure controller 7 that controls the pressure in the holding furnace 3.

Figure 4:
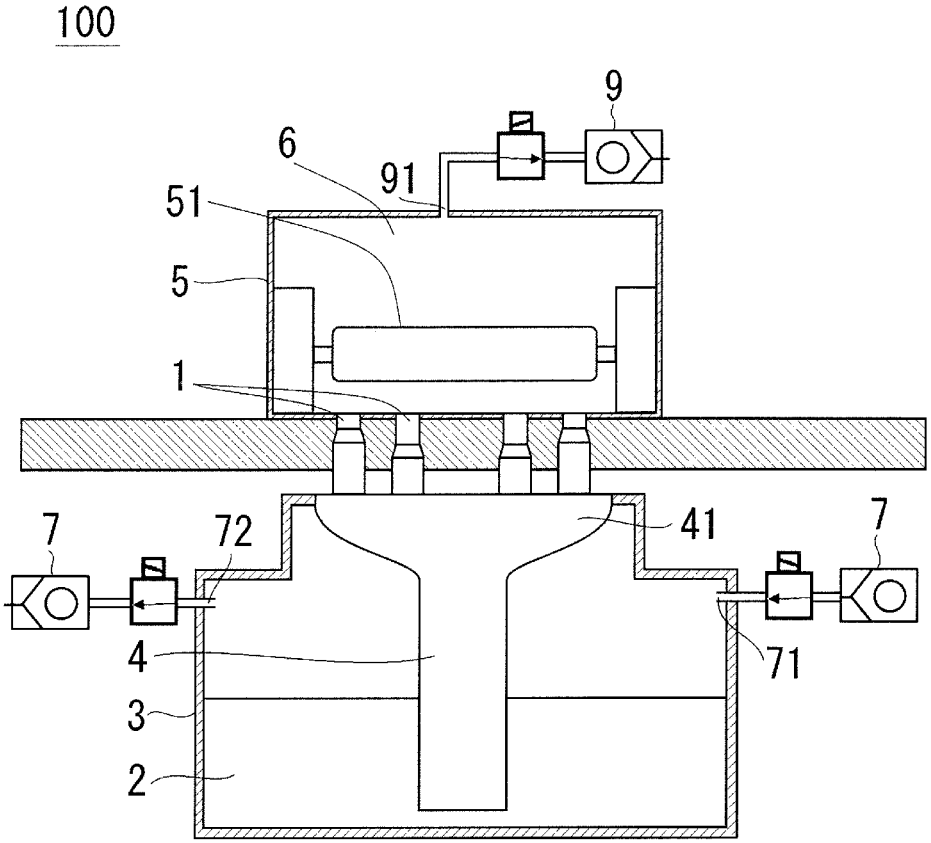
FIG. 4 illustrates an example of the low-pressure casting device of the present invention.

FIG. 4 illustrates an example of the low-pressure casting device 100. The low-pressure casting device 100 includes a gas inlet 71 for pumping inert gas such as carbon dioxide to the airtightly sealed holding furnace 3. The lower end of the stalk 4 is dipped in the molten metal 2 in the holding furnace 3. Above the holding furnace 3, a splittable mold 5 is disposed. A space is formed in each of the mold faces of the mold 5, and a cavity 6 having the shape of a molded product 8 is formed by assembling the mold 5.

The sprues 1 are disposed on the upper end of the stalk 4 to communicate the stalk 4 with the cavity 6.

If necessary, the mold 5 may have a suction pathway 91 that is connected to a suctioning device 9. Further, if necessary, a core 51 may be disposed in the mold 5.

In the low-pressure casting device 100, the pressure controller 7 injects gas into the holding furnace 3 through the gas inlet 71 so as to increase the pressure in the holding furnace 3. With the pressure, the gas presses the molten metal surface of the holding furnace 3 to raise the molten metal 2 in the stalk 4 so that the cavity 6 of the mold 5 is filled with the molten metal 2 through the sprues 1.

Then, after the molten metal 2 in the cavity 6 is cooled and solidified, the pressure controller 7 decreases the pressure in the holding furnace 3 so as to lower the molten metal surface. Thereafter, the mold 5 is opened, and the molded product 8 is collected.

It is preferred that the low-pressure casting device 100 includes a plurality of sprues 1. With the plurality of sprues 1, it is possible to supply the molten metal 2 to a wide area in the cavity 6. Therefore, the delivery is improved.

Further, the plurality of sprues 1 may be configured to have different thicknesses or perimeters of the cavity connection parts 13, and/or different lengths in the flow direction of the molten metal 2. By changing the shape of the cavity connection parts 13 to balance the solidification time of the sprues, clogging of the sprues is prevented.

It is preferred that the stalk 4 includes an expanding part 41 with a diameter increasing toward the sprues 1, and a plurality of sprues 1 are disposed to the expanding part 41. Further, it is preferred that the expanding part 41 is disposed inside the holding furnace 3. By the disposal inside the holding furnace 3, the heat of the holding furnace 3 prevents a decrease in temperature of the molten metal in the expanding part 41.

It is preferred that the low-pressure casting device 100 according to the present invention includes a suctioning device 9 that vacuums the cavity 6 through the suction pathway 91 of the mold. Supplying the molten metal 2 while vacuuming the cavity 6 can improve the delivery and prevent ruffle of the molten metal 2. Furthermore, since it becomes possible to increase the supply rate of the molten metal 2, the cycle time can be reduced.

REFERENCE SINGS LIST

1 Sprue
11 Stalk connection part
12 Molten metal reservoir
13 Cavity connection part
14 Heater
2 Molten metal
3 Holding Furnace
4 Stalk
41 Expanding part
5 Mold
51 Core
6 Cavity
7 Pressure controller
71 Gas inlet
72 Gas outlet
8 Molded product
9 Suctioning device
91 Suction pathway
100 Low-pressure casting device

The invention claimed is:

1. A sprue structure that is used for a low-pressure casting device to communicate a stalk with a cavity of a mold, the sprue structure comprising:

a stalk connection part configured to be connected to the stalk of the low-pressure casting device;

a molten metal reservoir; and a cavity connection part configured to be connected to the cavity, wherein a shape of the molten metal reservoir is such that the molten metal reservoir has a circular cross section at a connection to the stalk connection part and a non-circular cross section at a connection to the cavity connection part such that a perimeter of each cross section of the molten metal reservoir perpendicular to a flow direction of molten metal gradually changes from the circular cross section at the connection to the stalk connection part to the non-circular cross section at the connection to the cavity connection part while an area of each cross section remains constant.

2. The sprue structure for a low-pressure casting device according to claim 1, wherein the stalk connection part has a circular cross section.

3. The sprue structure for a low-pressure casting device according to claim 1, further comprising a heater configured to heat the molten metal reservoir.

4. A low-pressure casting device, comprising: a holding furnace configured to hold molten metal; a stalk with a lower end configured to be dipped in the molten metal in the holding furnace; a sprue communicating the stalk to a cavity of a mold; and a pressure controller configured to control a pressure in the holding furnace, wherein the sprue comprises:

a stalk connection part configured to be connected to the stalk;

a molten metal reservoir; and a cavity connection part configured to be connected to the cavity, and the shape of the molten metal reservoir is such that the molten metal reservoir has a circular cross section at a connection to the stalk connection part and a non-circular cross section at a connection to the cavity connection part such that a perimeter of each cross section of the molten metal reservoir perpendicular to a flow direction of the molten metal gradually changes from the circular cross section at the connection to the stalk to the non-circular cross section at the connection to the cavity connection part while an area of each cross section remains constant.

5. The low-pressure casting device according to claim 4, wherein the sprue comprises a plurality of sprues, and the plurality of sprues have one or both of different lengths of cavity connection parts and different perimeters of the cavity connection parts.

6. The low-pressure casting device according to claim 4, wherein the stalk comprises an expanding part with a diameter increasing toward the sprue, and the expanding part is disposed inside the holding furnace.

7. The low-pressure casting device according to claim 4, further comprising a suctioning device configured to vacuum the cavity.

8. The low-pressure casting device according to claim 4, wherein the stalk connection part has a circular cross section.

9. The low-pressure casting device according to claim 4, further comprising a heater configured to heat the molten metal reservoir.

* * * * *